United States Patent [19]

Ryerson

[11] Patent Number: 4,802,537

[45] Date of Patent: Feb. 7, 1989

[54] CONTROL CIRCUIT FOR POSITIONING AND TILTING AN EARTHMOVING BLADE

[75] Inventor: Lee T. Ryerson, Graymont, Ill.

[73] Assignee: Caterpillar Inc., Peoria, Ill.

[21] Appl. No.: 778,462

[22] Filed: Sep. 20, 1985

[51] Int. Cl.[4] ..... E02F 3/85; F15B 13/06

[52] U.S. Cl. ..... 172/812; 91/529; 91/536; 172/826

[58] Field of Search ..... 91/526, 529, 531, 536; 172/812, 826

[56] References Cited

U.S. PATENT DOCUMENTS

| | | | |
|---|---|---|---|
| 3,150,568 | 9/1964 | Junck | 91/531 |
| 3,181,431 | 5/1965 | Hein | 91/531 |
| 3,304,633 | 2/1967 | Hein | 91/531 |
| 3,512,453 | 5/1970 | Balzer | 91/529 |
| 3,966,066 | 6/1976 | Schexhayder | 91/531 |
| 3,987,920 | 10/1976 | Parquet | 91/529 |
| 4,294,287 | 10/1981 | Boswell | 91/536 |

*Primary Examiner*—Robert E. Garrett
*Assistant Examiner*—George Kapsalas
*Attorney, Agent, or Firm*—John W. Grant

[57] ABSTRACT

Fluid control circuits commonly control actuation of a pair of cylinders for positioning an earthmoving blade. The known circuits for providing the three operating modes of the cylinders utilize a separate control valve for each cylinder thereby making precise positioning of the blade difficult since such positioning requires coordinated control of both valves. The subject fluid control circuit includes a selector valve for determining the direction of fluid flow to and from the head end and rod ends of the tilt cylinders and a single control valve for modulating and controlling the fluid flow from the pump to the cylinders. With this circuit, the selector valve can be prepositioned in the desired position prior to actuating the control valve so that dual cylinder tip, dual cylinder tilt, and single cylinder tilt of the blade is readily controlled by manipulation of only the single control valve.

8 Claims, 1 Drawing Sheet

CONTROL CIRCUIT FOR POSITIONING AND TILTING AN EARTHMOVING BLADE

BACKGROUND OF THE INVENTION

1. Field of the Invention

This invention relates generally to a fluid control circuit for positioning an earthmoving blade and more particularly to a circuit for providing dual cylinder tip of the blade, dual cylinder tilt of the blade and single cylinder tilt of the blade.

2. Description of the Prior Art

Many earthmoving vehicles have a blade mounted on the front end thereof for pushing or dozing material. The blade of such vehicles is commonly mounted such that it can be raised and lowered through the use of one or more double-acting hydraulic cylinders. Additionally, the blade of some such vehicles is mounted such that it can be tilted about a horizontal axis generally perpendicular to the blade through the use of only a single hydraulic cylinder. The blade of other such vehicles is mounted such that it can be both tilted and tipped fore and aft about a horizontal axis substantially parallel with the blade through the use of dual hydraulic cylinders one at each side of the blade. Tilting is accomplished by extending one hydraulic cylinder and retracting the other hydraulic cylinder and tipping is accomplished by extending or retracting both cylinders at the same time.

One known hydraulic system for controlling actuation of the dual hydraulic cylinders uses two control valves which are in fluid communication with a selector valve which is in turn connected to the dual hydraulic cylinders. The selector valve is a two position valve with which the operator can select one of two modes of positioning the blade, i.e. dual cylinder tilting or dual cylinder tipping. A single mechanical control mechanism is connected to both of the control valves so that they are operated in unison by the vehicle operator for directing fluid to the appropriate ends of the dual cylinders as selected by the position of the selector valve. One of the problems with that system is that using two control valves adds undue cost to the system while the mechanism connecting the two control valves to a single operator control lever adds both cost and complexity thereto. Moreover, that system has only dual cylinder tilting and dual cylinder tipping capability.

It has been found that in many cases the blade can be made more versatile if the dual cylinder arrangement is provided with controls which provide a single cylinder tilt function. In such arrangement, dual cylinder tilting of the blade is utilized when rapid changing of the blade position is desired and single cylinder tilting of the blade is utilized when it is desirable to apply maximum force to only one corner of the blade.

The heretofore known arrangements having both dual cylinder and single cylinder tilting capability of the blade employ a pair of control valves with each control valve being operatively connected to a respective one of the two tilt cylinders. One of the problems encountered therewith is a problem encountered by the vehicle operator in trying to precisely position the blade. Since the position of the blade is dependent upon coordinated modulation of two separate control valves by the operator, such precise positioning of the blade is very difficult. In at least one such known arrangement, one of the control valves is solenoid actuated and thereby makes precise positioning of the blade even more difficult since the operator only has control of the direction of fluid flow to the tilt cylinder controlled by the solenoid actuated control valve and has virtually no control over the amount of fluid flow to that cylinder.

The present invention is directed to overcoming one or more of the problems as set forth above.

SUMMARY OF THE INVENTION

In one aspect of the present invention, a fluid control circuit for an earthmoving blade suitably supported on a vehicle so that the tilt and tip orientation of the blade relatively to the ground is controlled by first and second double acting fluid pressure cylinders includes a tank and a pump. A single control valve has an inlet port connected to the pump, an exhaust port connected to the tank, and first and second control ports. The control valve is movable to a first position at which fluid from said pump is directed through the first control port and to a second position at which fluid from the pump is directed through the second control port. The first control port is connected to one of the ports of the first cylinder. A selector valve is connected to the second control port of the control valve, the other port of the first cylinder, and to the head end and rod end ports of the second cylinder. The selector valve is movable to first, second and third positions. The selector valve at the first position provides dual cylinder tilting of the blade wherein the first cylinder extends and the second cylinder retracts when the control valve is at one of said positions and the first cylinder retracts and the second cylinder extends when the control valve is at the other of said positions. The selector valve at the second position provides dual cylinder tipping of the blade wherein the first and second cylinders both extend when the control valve is at said one position and retract when the control valve is at the other position. The selector valve at the third position provides single cylinder tilting of the blade wherein the first cylinder extends and retracts and the second cylinder is hydraulically locked at a fixed position at said one and said other position respectively of the control valve.

In another aspect of the present invention, a selector valve comprises a body having a bore, an inlet-outlet port, and first, second and third motor ports therein. A spool is slidably positioned in the bore and movable to a first position at which the inlet-outlet port is in communication with the third motor port and the second port is in communication with the first motor port, to a second position at which the inlet-outlet port is in communication with the first motor port and the third motor port is in communication with the first motor port, and to a third position at which the inlet-outlet port is in communication with the first motor port and the second and third motor ports are blocked.

The present invention provides a control circuit for dual cylinder tip, dual cylinder tilt and single cylinder tilt of an earthmoving blade with the control circuit enabling the operator to easily precisely position the blade. The circuit utilizes a selector valve in combination with a single control valve to select the desired blade function i.e. dual cylinder tip, dual cylinder tilt or single cylinder tilt. The control valve is used solely to modulatably control fluid flow to and from the pair of tilt cylinders in the particular pattern selected by the selector valve. Thus, since the actuation of both cylinders is controlled by fluid flow through the single control valve, the operator has only one control valve to manipulate in all three operating modes.

DETAILED DESCRIPTION OF THE PREFERRED EMBODIMENT

Figure 1:
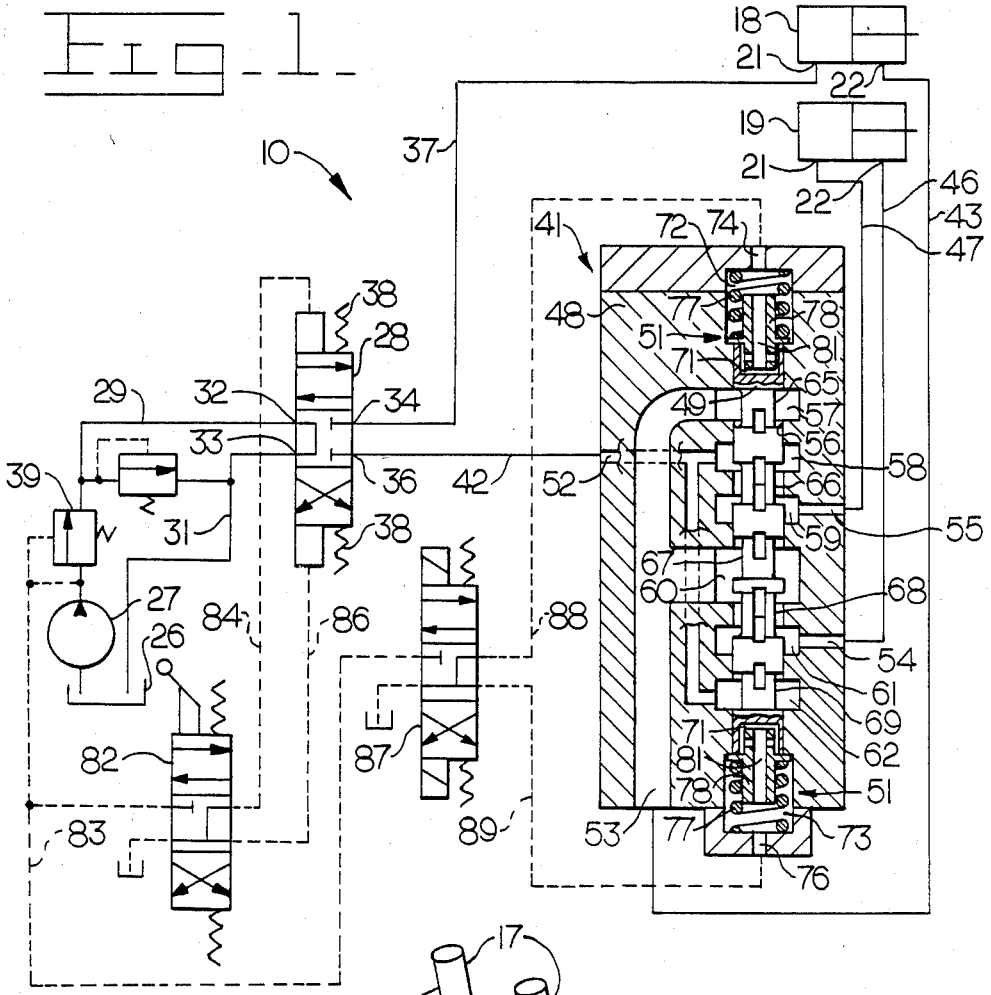
FIG. 1 is a schematic illustration of a control circuit of an embodiment of the present invention.
Figure 2:
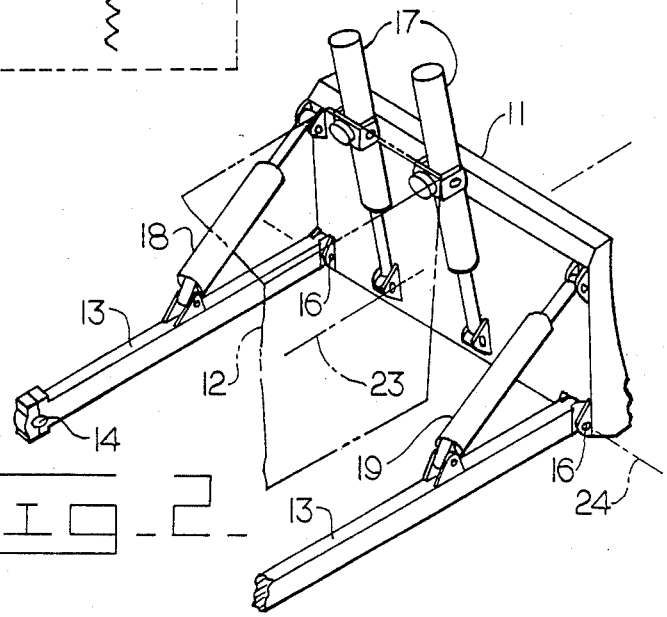
FIG. 2 is an elevational perspective view of a representative blade which is variably positioned by the control circuit of the present invention and further illustrating in fragmentary phantom outline a representative vehicle on which the bulldozer blade is pivotally mounted.

Referring to the drawings, a control circuit 10 is illustrated for positioning an earthmoving blade 11 suitably supported on a vehicle 12. The support for the blade 11 includes a pair of push arms 13 mounted on opposite sides of the vehicle 12 through a pair of universal connections 14. The blade 11 is pivotally connected to the forward ends of the push arms 13 by a pair of universal connections 16. A pair of double-acting fluid pressure lift cylinders 17 are coupled intermediate the vehicle 12 and the blade 11 for raising and lowering it in the usual manner. A pair of double-acting fluid pressure tilt cylinders 18,19 are mounted intermediate the push arms 13 and the blade 11 for tilting and tipping the blade relative to the vehicle. Each of the cylinders 18,19 have a head end port 21 and a rod end port 22.

It should hereinafter be appreciated that in this application tilting is the action of moving the blade 11 about a horizontally arranged longitudinal axis 23 substantially perpendicular to the blade whereas tipping is the action of moving the blade about a horizontally arranged transverse axis 24 substantially parallel to the blade.

The control circuit 10 includes a tank 26, a pump 27 and a control valve 28 connected to the pump 27 through a supply line 29 and to the tank 26 through a drain line 31. The control valve 28 has an inlet port 32 connected to the supply line 29, an exhaust port 33 connected to the drain line 31, and a pair of control ports 34,36. The control port 34 is connected to the head end port 21 of the cylinder 18 through a motor line 37. The control valve 28 is a three position four way pilot operated valve and is normally spring biased to a neutral position by a pair of centering springs 38. A restrictor valve 39 is disposed in the supply line 29 for maintaining a minimum fluid pressure upstream thereof as a source of pilot fluid.

The control circuit 10 also includes a selector valve 41 connected to the control port 36 of the control valve 28 through a line 42, to the rod end port 22 of the cylinder 18 through a motor line 43 and to the rod end port 22 and head end port 21 of the cylinder 19 through a pair of motor lines 46,47 respectively.

The selector valve 41 includes a body 48, a spool 49 and a pair of resilient centering mechanisms 51 disposed at opposite ends of the spool 49. The body 48 has an inlet-outlet port 52 connected to the line 42 and three motor ports 53,54,55 connected to the motor lines 43, 46 and 47 respectively. The body also has an elongate bore 56 therein and a plurality of annular grooves 57–62 axially spaced along and intersecting with the bore 56. The motor port 43 is in continuous communication with the annular grooves 57 and 60 and the motor ports 54 and 55 are in continuous communication with the annular grooves 61 and 59 respectively. The inlet-outlet port 52 is in continuous communication with the annular grooves 58 and 62.

The spool 49 is slidably positioned in the bore 56 and has a plurality of annular flow control grooves 65–69 axially spaced along its length. A recess 71 is formed in each end of the spool. A pair of actuating chambers 72,73 are defined in the body 48 at opposite ends of the spool 49. A pair of ports 74,76 in the body 48 communicate with the actuating chamber 72,73 respectively.

Each of the centering mechanisms 51 includes a coil spring 77 and a spring retainer 78 positioned in the respective actuating chamber 72,73. Each spring retainer has a fluid flow passage 81 communicating the actuating chamber with the end of the spool.

A manually actuated pilot control valve 82 is connected to the supply line 29 upstream of the restrictor valve 39 through a pilot supply line 83. The pilot control valve 82 is connected to opposite ends of the control valve 28 through a pair of pilot lines 84,86. A solenoid actuated pilot valve 87 is connected to the pilot supply line 83 and to the ports 74,76 of the body 48 through a pair of pilot lines 88,89 respectively. The solenoid valve is actuated in the usual manner by manual actuation of an electrical switch suitably connected to a source of electrical energy. Typically, the electrical switch could be mounted on the control lever connected to the pilot control valve 82 or other convenient locations at the operator's station.

Industrial Applicability

In the use of the control circuit 10, the operator can select one of three different modes of varying the position of the blade 11 by selectively positioning the spool 49 of the selector valve 41 and then axially positioning the blade through actuation of the control valve 28. The spool 49 is movable to three distinct positions and is shown in the first position. At the first position, the inlet-outlet port 52 is in communication with the motor port 55 via the annular groove 58, the flow control groove 66 and the annular groove 59, and the motor port 53 is in communication with the motor port 54 via the annular groove 60, the flow control groove 68 and the annular groove 61. The spool 49 is movable upwardly as viewed in the drawing from the first position to a second position at which the inlet-outlet port 52 is in communication with the motor port 54 via the annular groove 62, the flow control groove 69 and the annular groove 61, and the motor port 53 is in communication with the motor port 55 via the annular groove 60, the flow control groove 67 and the annular groove 59. The spool is movable downwardly from the first position to a third position at which the inlet-outlet port 52 is in communication with the motor port 53 via the annular groove 58, the flow control groove 65 and the annular groove 57, and the motor ports 54 and 55 are blocked by the spool.

The control valve 28 is movable from the neutral position shown to first and second operating positions. At the neutral position, the inlet port 32 is in communication with the exhaust port 33 and the control ports 34,36 are blocked. The control valve is moved downwardly from the neutral position to the first operating position at which the inlet port 32 communicates with the control port 34 and the control port 36 communicates with the exhaust port 33. The control valve 28 is moved upwardly to the second operating position at which the inlet port 32 is in communication with the control port 36 and the control port 34 is in communication with the exhaust port 33. It is to be understood that each of the first and second operating positions of the control valve 28 includes an infinite number of positions for modulatably controlling fluid flow therethrough. The control valve is moved to the first and second positions by manual actuation of the pilot control valve 82 to direct pilot fluid from the pilot supply line 83 through the appropriate pilot line 84 or 86.

The first mode of varying the blade position is referred to as dual cylinder tilt in which one of the tilt cylinders 18,19 is extended and the other tilt cylinder is retracted. Dual cylinder tilt is achieved with the spool 49 of the selector valve 41 at the position shown. This position of the spool 49 is achieved when the solenoid valve 87 is deenergized and at the position shown wherein both actuating chambers 72,73 are vented to tank. With the spool 49 at the first position, actuation of the control valve 28 to the first position directs fluid from the pump 27 through the motor line 37 to the head end port 21 of the tilt cylinder 18 thereby causing extension of the tilt cylinder 18. The fluid exhausted from the tilt cylinder 18 through the rod end port 22 is routed through the motor line 43, the selector valve 41 and the motor conduit 46 to the tilt cylinder 19 through the rod end port 22 thereby causing retraction of the tilt cylinder 19. The fluid exhausted from the tilt cylinder 19 through the head end port 21 is routed through the motor conduit 47, the selector valve, and the line 42 to the control valve 28 where it is exhausted to the tank 26 through the drain line 31.

Conversely, moving the control valve 28 to the second operating position directs fluid from the pump 27 through the line 42, the selector valve 41, the motor lines 46,47,37, and the tilt cylinders 18,19 in a reverse direction than that described above resulting in extension of the tilt cylinder 19 and retraction of the tilt cylinder 18.

The second mode of positioning the blade 11 is referred to as dual cylinder tip in which both the tilt cylinders 18,19 are extended or retracted at the same time. Dual cylinder tip is selected by the operator selectively energizing the solenoid valve 87 to direct pilot fluid through the pilot line 89 to the actuating chamber 73 causing the spool to move upwardly to the second position. The control valve 28 is then moved to either the first or second operating positions depending upon which direction the operator wants the blade to tip.

Tipping the blade 11 forward about the axis 24 is initiated by moving the control valve 28 downwardly to the first position to communicate fluid from the pump 27 through the motor line 37 to the head end port 21 of the tilt cylinder 18 causing it to extend. The fluid exhausted from the tilt cylinder 18 through the rod end port 22 is routed through the motor line 43, the selector valve 41, and the motor line 47 to the head end port 21 of the tilt cylinder 19 causing it to also extend. The fluid exhausted from the tilt cylinder 19 through the rod end port 22 is routed through the motor line 46, the selector valve 41, the line 42, and the control valve 28 to the tank 26.

Tipping the blade 11 rearwardly about the axis 24 is initiated by moving the control valve 28 upwardly to its second operating position to communicate fluid from the pump 27 through the line 42, the selector valve 41, and the motor line 46 to the rod end port 22 of the tilt cylinder 19 causing it to retract. The fluid exhausted from the tilt cylinder 19 through the head end port 21 is routed through the motor line 47, the selector valve 41, the motor line 43 and to the rod end port 22 of tilt cylinder 18 causing the cylinder 18 to also retract. The fluid exhausted from the tilt cylinder 18 through the head end port 21 is directed through the motor line 37 and the control valve 28 to the tank 26.

The third mode of positioning the blade 11 is referred to as single cylinder tilt in which the tilt cylinder 18 is extended or retracted while the tilt cylinder 19 remains hydraulically locked in a fixed position. Single cylinder tilt is selected by the operator selectively energizing the solenoid valve 87 to direct pressurized fluid through the pilot line 88 to the actuating chamber 72 causing the spool 49 to move downwardly to the third position. The control valve 28 is then moved to either the first or second operating positions depending upon which direction the operator wants the blade to be tilted.

Tilting the blade counterclockwise about the axis 23 is initiated by moving the control valve 28 downwardly to the first operating position to communicate fluid from the pump 27 through the motor line 37 to the head end port 21 of the tilt cylinder 18 causing it to extend. The fluid exhausted from the tilt cylinder 18 through the rod end port 22 is routed through the motor line 43, the selector valve 41, the line 42 and the control valve 28 to the tank 26. With the valve spool 49 at the third position the motor ports 54 and 55 are blocked by the spool thereby hydraulically locking the tilt cylinder 19 at a fixed position. Tilting the blade 11 counterclockwise about the axis 23 is initiated by moving the control valve 28 upwardly to its second operating position to direct fluid from the pump 27 through the line 42, the selector valve 41 and the motor line 43 to the rod end port 22 of the tilt cylinder 18. The fluid exhausted from the tilt cylinder 18 through the head end port 21 is routed through the motor line 37 and the control valve 28 to the tank 26.

In view of the foregoing, it is readily apparent that the present invention provides an improved control circuit for positioning an earthmoving blade by one of three different operating modes. The control circuit utilizes a three position selector valve to select the desired operating mode of changing the blade position and a single control valve to modulatably control the flow of fluid to and from the tilt cylinders in the manner selected by the selector valve. Since the selector valve is simply used only to select the direction of fluid flow, the operator can position it in one of the three positions and thereafter use only the single control valve for modulatably controlling the amount of fluid flow to the tilt cylinders for precise positioning of the blade.

Other aspects, objects and advantages can be obtained from the drawings, the disclosure and the appended claims.

I claim:

1. A fluid control circuit for an earthmoving blade suitably supported on a vehicle so that the tilt and tip positioning of the blade relative to the ground is controlled by first and second double-acting fluid pressure cylinders, each of which has a head end port and a rod end port, comprising:

a tank;

a pump;

a single control valve having an inlet port connected to the pump, an exhaust port connected to the tank, and first and second control ports, said control valve being movable to a first position at which fluid from the pump is directed through said first control port and to a second position at which fluid from said pump is directed through the second control port, said first control port being connected to one of the ports of the first cylinder; and a selector valve connected to the second control port of the control valve, to the other port of the first cylinder, and to the ports of the second cylinder, said selector valve being movable to a first position to provide fluid powered dual cylinder tilting of the blade wherein the first cylinder extends and the second cylinder retracts when the control valve is moved to one of said positions and the first cylinder retracts and the second cylinder extends when the control valve is moved to the other of said positions, a second position to provide fluid powered dual cylinder tipping of the blade wherein the first and second cylinders both extend when the control valve is moved to said one position and retract when the control valve is moved to said other position, and to a third position to provide fluid powered single cylinder tilting of the blade wherein the second cylinder is hydraulically locked at a fixed position and the first cylinder extends and retracts when the control valve is moved to said one and said other position respectively.

2. The fluid control circuit of claim 1 wherein said selector valve includes a body having a bore, an inlet-outlet port, and first, second and third motor ports therein, said inlet-outlet port being connected to the second control port of the control valve, said first motor port being connected to said one port of the first cylinder, said second motor port being connected to one of the ports of the second cylinder, said third motor port being connected to the other port of the second cylinder; and a spool slidably positioned in the bore and movable to a first position at which the inlet-outlet port is in communication only with the third motor port and the second motor port is in communication only with the first motor port, to a second position at which the inlet-outlet port is in communication with the second motor port and the third motor port is in communication with the first motor port, and to a third position at which the inlet-outlet port is in communication only with the first motor port and the second and third motor ports are blocked.

3. The fluid control circuit of claim 2 wherein said body includes first, second, third, fourth, fifth and sixth annular grooves longitudinally spaced along and intersecting with the bore, said inlet-outlet port being in continuous communication with the second and sixth annular grooves, said first motor port being in continuous communication with the first and fourth annular grooves, said second motor port being in continuous communication with the fifth annular groove, and said third motor port being in continuous communication with the third annular groove.

4. The fluid control circuit of claim 3 wherein the second annular groove is in communication with the third annular groove and the fourth annular groove is in communication with the fifth annular groove and the sixth annular groove is isolated from the fifth annular groove at the first position of the valve spool; said third annular groove is in communication with the fourth annular groove, said fifth annular groove is in communication with said sixth annular groove and the second annular groove is blocked from the first and third annular grooves at the second position of the valve spool; and said first annular groove is in communication with the second annular groove and said third and fifth annular grooves are each isolated from the other annular grooves and the sixth annular groove is isolated from the fifth annular groove at the third position of the valve spool.

5. A fluid control circuit for selectively controlling delivery of fluid to and from the head end ports and the rod end ports of first and second double-acting fluid pressure cylinders connected to a work implement comprising:

a tank;

a pump;

a single control valve having an inlet port connected to the pump, an exhaust port connected to the tank, first and second control ports, said control valve normally positioned at a neutral position at which the first and second control ports are blocked from each other and from the inlet and exhaust ports and being movable to a first position at which the inlet port is in communication with the first control port and the second control port is in communication with the exhaust port, and to a second position at which the inlet port is in communication with the second control port and the first control port is in communication with the exhaust port, said first control port being connected to one of the ports of the first cylinder; and a selector valve having an inlet-outlet port connected to the second control port of the control valve, a first motor port connected to the other port of the first cylinder, a second motor port connected to one of the ports of the second cylinder, a third motor port connected to the other port of the second cylinder, and a single spool normally positioned at a first position at which the second control port of the control valve is in communication with said other port of the second cylinder and the one port of the second cylinder is in communication with the other port of the first cylinder, said spool being movable to a second position at which the second control port of the control valve is in communication with said one port of the second cylinder and said other port of the second cylinder is in communication with said other port of the first cylinder, and to a third position at which the second control port of the control valve is in communication with said other port of the first cylinder and communication to and from the ports of the second cylinder is blocked.

6. The fluid control circuit of claim 5 wherein said selector valve includes a body having a bore, the inlet-outlet port, and the first, second and third motor ports therein, and a spool slidably positioned in the bore and movable to a first position at which the inlet-outlet port is in communication with the third motor port and the second motor port is in communication with the first motor port, to a second position at which the inlet-outlet port is in communication with the second motor port and the third motor port is in communication with the first motor port, and to a third position at which the inlet-outlet port is in communication with the first motor port and the second and third motor ports are blocked.

7. The fluid control circuit of claim 6 wherein said body includes first, second, third, fourth, fifth and sixth annular grooves longitudinally spaced along and intersecting with the bore, said inlet-outlet port being in continuous communication with the second and sixth annular grooves, said first motor port being in continuous communication with the first and fourth annular grooves, said second motor port being in continuous communication with the fifth annular groove, and said third motor port being in continuous communication with the third annular groove.

8. The fluid control circuit of claim 7 wherein the second annular groove is in communication with the third annular groove and the fourth annular groove is in communication with the fifth annular groove and the sixth annular groove is isolated from the fifth annular groove at the first position of the valve spool; said third annular groove is in communication with the fourth annular groove, said fifth annular groove is in communication with said sixth annular groove and the second annular groove is blocked from the first and third annular grooves at the second position of the valve spool; and said first annular groove is in communication with the second annular groove and said third and fifth annular grooves are each isolated from the other annular grooves and the sixth annular groove is isolated from the fifth annular groove at the third position of the valve spool.

* * * * *